US005725910A

United States Patent [19]

Devine et al.

[11] Patent Number: 5,725,910

[45] Date of Patent: Mar. 10, 1998

[54] EDGE REMOVAL APPARATUS FOR CURTAIN COATING

[75] Inventors: William D. Devine, Rochester; Douglas B. Humby, Hilton; Kenneth J. Ruschak, Rochester, all of N.Y.

[73] Assignee: Eastman Kodak Company, Rochester, N.Y.

[21] Appl. No.: 795,987

[22] Filed: Feb. 5, 1997

[51] Int. Cl.[6] ..... B05D 1/30

[52] U.S. Cl. ..... 427/420; 118/324; 118/DIG. 4; 427/294

[58] Field of Search ..... 427/420, 294; 118/DIG. 4, 324

[56] References Cited

U.S. PATENT DOCUMENTS 3,508,947 4/1970 Hughes .
4,647,482 3/1987 Degrauwe et al. ..... 118/DIG. 4
4,830,887 5/1989 Reiter ..... 427/420
5,328,726 7/1994 Reiter ..... 427/420
5,395,660 3/1995 Ruschak et al. ..... 427/420

*Primary Examiner*—Katherine A. Bareford
*Attorney, Agent, or Firm*—Arthur H. Rosenstein

[57] ABSTRACT

The present invention is an edge blade attached to an edge guide for removing an edge of a falling curtain. The edge of the falling curtain is intercepted by the edge blade and is vacuumed away by a vacuum tube disposed near the edge blade wherein the blade is extending from the edge guide into the falling curtain to intercept a part of the free falling curtain and positioning the blade above the impingement of the falling curtain on the support wherein the blade is angled into the free falling curtain so that the blade is closest to the support where the part of the free falling curtain is intercepted and farthest from the support at the edge guide. Air to the vacuum tube is blocked from the outboard direction, and the tube is directed to draw air from the inboard direction towards the curtain.

6 Claims, 6 Drawing Sheets

EDGE REMOVAL APPARATUS FOR CURTAIN COATING

FIELD OF THE INVENTION

This invention relates generally to coating apparatus and, more particularly, to the curtain coating of multiple layers.

BACKGROUND OF THE INVENTION

In coating apparatus of the curtain coating type, the moving support is coated by causing a free falling curtain of coating liquid to impinge onto the moving support to form a layer on said support. An apparatus is described and used in U.S. Pat. No. 3,508,947 wherein a multilayer composite of a plurality of distinct layers is formed on a slide hopper and caused to impinge onto an object or moving support to form a coated layer thereon. U.S. Pat. No. 3,508,947 particularly relates to the manufacture of multilayer photographic materials such as photographic film and paper.

In the coating of photographic products, it is necessary to constrain the edges of the curtain to eliminate narrowing of the curtain and a reduction in coating width. It is desirable to have the edges of the curtain be internal to the edges of the film or paper base, henceforth this will be referred to as internal edging. Internal edging is preferable to the practice of maintaining a curtain wider than the base and coating over the edges of the base. However, the edge guides are solid surfaces which slow the coating liquids because of drag they produce. This reduction in velocity results in a significant penalty in the maximum coating speed attainable near the edge. The prior art teaches introducing a lubricating band of water, or another low viscosity liquid, along the edge guide to reduce the drag and increase the velocity of the coating solutions in the curtain. This water layer or low viscosity liquid band must, however, be removed in order to maintain acceptable coating latitude and quality and to avoid any penalty in speed for drying the edges. In the removal of the lubricating band the velocity of the coating liquids must not be reduced in the vicinity of the edge if high speed coating is desired. The prior art teaches the use of a vertical slit connected to a vacuum source at the bottom of the edge guide as the means by which the lubricating water is removed. This is described in U.S. Pat. No. 4,830,887 which is incorporated by reference herein. This technique tends to slow down the coating liquids as the lubricating layer is being removed, hence reducing the maximum attainable coating speed at the edge. Also, some lubricating liquid may flow beyond the slit and not be captured.

Therefore, it is desirable to remove the lubricating liquid layer very abruptly giving the coating liquids near the edge guide very little opportunity to slow down. This maximizes the momentum of the coating liquids in the falling curtain and therefore, maximizes the attainable coating speeds for the specific layer viscosities and flow rates being used. It is also desirable to ensure complete removal of the lubricating liquid.

U.S. Pat. No. 5,395,660 describes a method and apparatus by which the lubricating band of liquid and/or edge of the curtain in a curtain coating operation are removed. This is achieved by having the lubricating liquid and optionally, an adjacent narrow section of the curtain fall onto a thin solid blade. The lubricating liquid and curtain which impinge on the blade are then vacuumed away. This allows the remaining curtain to coat with little or no reduction in velocity due to the removal of the edge band of the falling curtain.

The instant invention is an improvement to the U.S. Pat. No. 5,395,660.

Prior art, as described in U.S. Pat. No. 5,395,660, teaches an edge guide to maintain the width of the free falling curtain between the hopper lip and the support. The prior art also teaches the use of lubricating liquid adjacent to the edge guide, and the abrupt removal of this lubricating liquid and some adjacent portion of the coating composition just prior to coating. The lubricating liquid also serves to flush the edge guide so that coating composition cannot build up on the surfaces of the edge guide; thus, the edge guide lubricating liquid can also be referred to as edge guide flushing liquid. The interception is done by a solid blade closely spaced to the support, and the intercepted liquids are vacuumed away. The vacuuming can be done by a slot spaced at a small distance to the curtain of a width that approximates or exceeds the width of the intercepted liquids. The blade and slot together may be referred to as a vacuum block that is attached to the edge guide.

It has been found that coating liquids with a tendency to solidify may cause fouling of the internal and external surfaces of the vacuum block This buildup reduces the efficiency of the unit at extracting the portion of the curtain intercepted by the blade and ultimately plugs the unit completely. Thus, excess coating composition and eventually the edge guide flushing liquid are deposited on the support. The edges of the coating may therefore not dry causing such problems as contamination of support conveyance components and wound rolls of coated support that are stuck together at the edges.

When the coating composition includes a setting polymer such as bone gelatin, the solidification can be caused by below ambient temperatures on surfaces of the vacuum block. As the air drawn into the vacuum slot expands, it cools by at least several degrees and lowers the temperature of surrounding surfaces. Coating compositions contacting the block may then solidify.

When the coating composition is undergoing a cross-linking reaction, the solidification can be caused by this reaction proceeding on contacted surfaces of the vacuum block. In the manufacture of photographic products, the coating composition may include the gelatin polymer and a cross-linking agent, or hardener. The rate of this reaction increases with the concentrations of the reactants.

When the coating composition includes one or more volatile components subsequently evaporated in a dryer, the solidification can be due to evaporation from covered surfaces. Water is a common volatile component. Common solvents, such as acetone or alcohols, are much more volatile than water.

Whatever the mechanism for fouling, it has been found that over time, buildup occurs on exterior and interior surfaces of the vacuum block of the prior art. This buildup reduces the efficiency of the unit at extracting the portion of the curtain intercepted by the blade and ultimately plugs the unit completely. Thus, excess coating composition and eventually the edge guide flushing liquid are deposited on the web. The edges of the coating may therefore not dry causing such problems as contamination of web conveyance components and wound rolls of coated web that are stuck together at the edges.

It is surprising that any buildup should occur, because the high velocity air drawn into the vacuum block scours surfaces. The time for solidification would be expected to be long compared to the brief time that the coating composition might contact the vacuum block. What is more, the edge guide flushing liquid drawn into the vacuum block with the intercepted coating composition would be expected to flush the surfaces of the vacuum block.

In fact, however, there is a tendency for fouling. Depending upon the nature of the coating composition, partial plugging reducing the removal efficiency of the vacuum block and shutting down the coating operation can occur in as little time as an hour. In some cases, continuous coating for periods of days is desired.

SUMMARY OF THE INVENTION

The invention solves the problem of the fouling and clogging of the prior art vacuum block. The fouling represents solidified coating composition on the block.

It has been found that minimizing the extent of the intercepted coating compositions intercepted by the blade reduces the time to failure, even though the flushing liquid represents a greater proportion of the evacuated liquids. The intercepted coating composition becomes waste, so minimizing the amount of the curtain liquid intercepted is economically attractive.

A new way to reduce fouling and extend run times, has been found. The relation is to make geometric changes altering the air flow pattern while maintaining the same vacuum setting and slot height. This result is surprising because the velocity and temperature of the entering air are unaffected.

In the prior art, FIG. 1, the vacuum slot is spaced uniformly from the curtain by approximately 1 mm. The improvement shown in FIG. 2 involves three steps. The vacuum slot is set at a substantial angle β to the plane of the curtain, in the range of 10–50 degrees, so that the distance between the slot and curtain increases as the edge of the blade is approached. The second step is bringing the edge guide into contact with a vertical face of the vacuum block to block air access to the slot from the outboard direction. The third step is to terminate the vacuum slot before reaching the edge of the blade. These steps have the effect of maintaining the face of the block that surrounds the slot free of buildup. In some cases, some direct buildup may still take place on internal surfaces of the vacuum slot. The buildup usually has the appearance of a line extending around much or all of the perimeter of the cross section of the slot at a small distance inside the slot. Direct buildup inside the slot occurs more slowly than external buildup, but over time enough accumulation may occur to reduce the evacuation capacity of the slot significantly. For such cases, in addition to the above, the edge guide flushing liquid or additionally supplied flushing liquid can be distributed so as to encompass the intercepted coating composition. This distribution of flushing liquid can be accomplished by channels cut into external surfaces of the vacuum block and the top surface of the blade. For the top surface of the slot, flushing liquid in addition to the edge guide flushing liquid may optionally be supplied directly by a conduit with outlet in the top surface of the slot close to the slot entrance. In any case, flushing water between the intercepted coating composition and the internal surfaces of the vacuum slot precludes the direct buildup of coating composition inside the slot.

In addition to the above, additional flushing liquid can be supplied as shown in FIG. 3. At least one water channel is cut in the blade to bring both together water from an external supply to the blade surface at the threshold of the slot. This channel conveys flushing liquid to a portion or all of the blades surface at the slot entrance. Preferably the channel extends at least to the line of apparent intersection of the curtain and blade. Similarly, an externally supplied channel can be constructed to bring flushing liquid from an external source to the top and inboard sides of the slot. A more direct alternative is to create a conduit in the vacuum block that terminates in the top surface of the slot as shown in FIG. 4. The outlet of the conduit spans some portion or all of the top surface of the slot. The outlet must also be close to the slot entrance, within about 0.050 inch, or fouling can occur between the slot entrance and the outlet. For this reason the shape of the outlet is preferably squared off as shown in FIG. 4. The principal advantage of the conduit is that complete capture of the flushing liquid is certain.

Gravity and capillary wicking cause flushing liquid to fill the channels. Preferably the channels have a downward inclination to make use of gravity. To enhance capillary wicking, the channels are preferably narrow and of rectangular cross section. Capillary wicking in such channels can be so strong that flushing liquid can be carried even vertically upward, although a downward inclination is preferable. Thus a method of curtain coating a support with at least one layer of a liquid coating composition comprises:

a) moving the support along a path through a coating zone;

b) forming one or more layers of coating liquids to form a composite layer;

c) forming a free falling curtain from said composite layer within said coating zone which extends transversely of said path and impinges on said moving support;

d) laterally guiding said falling curtain by edge guides arranged so that the curtain coats less than the width of said support;

e) maintaining said falling curtain in wetting contact with said edge guides by distributing flushing liquid from said edge guides contiguous with said falling curtain;

f) removing liquids from an edge of said falling curtain by providing a blade extending from the edge guide into the falling curtain to intercept a part of the free falling curtain and positioning the blade above the impingement of the falling curtain on the support wherein the blade is angled into the free falling curtain so that the blade is closest to the support where the part of the free falling curtain is intercepted and farthest from the support at an edge guide;

g) removing by suction means the liquids of the free falling curtain intercepted by the blade; and h) blocking air to said suction means from an outboard direction and directing said suction means to draw air from an inboard direction towards the curtain.

Further, a preferred method includes beginning one end of the slot at a vertical surface in contact with an edge guide and extends toward a blade edge at an angle β of 10–50 degrees from the plane of the curtain and ends at a distance of 0.010–0.060 inches from the edge of the blade.

Even further, the method preferably includes apparatus for curtain coating a support by depositing one or more coating liquids onto a moving support comprising:

a) conveying means including a coating roll for moving said support having a width along a path through a coating zone;

b) hopper means for forming one or more flowing layers of coated liquids to form a free falling curtain which extends transversely of said path and impinges on said moving support;

c) edge guide means spaced a distance apart to produce a coating less than the width of said support for laterally guiding said falling curtain;

d) flushing means for issuing liquid from said edge guide to maintain wetting contact with said falling curtain;

e) liquid removal means for extracting liquid from an edge region of said falling curtain, the liquid removal means comprising:

i) a blade having an upper surface extending into the free falling curtain to intercept a part of the free falling curtain, said blade not contacting said support;

ii) a slot aligned and adjacent the upper surface of said blade, a face surface of the slot starting as a vertical surface in contact with an edge guide, and said slot making an angle β with the plane of the curtain such that the distance of the slot from the curtain increases as the edge of the blade is approached, and terminating the slot before the edge of the blade; and iii) suction means for providing a vacuum to said slot wherein the part of the free falling curtain intercepted by said blade is suctioned through said slot such that drag on the free falling curtain is minimized.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

Figure 1:
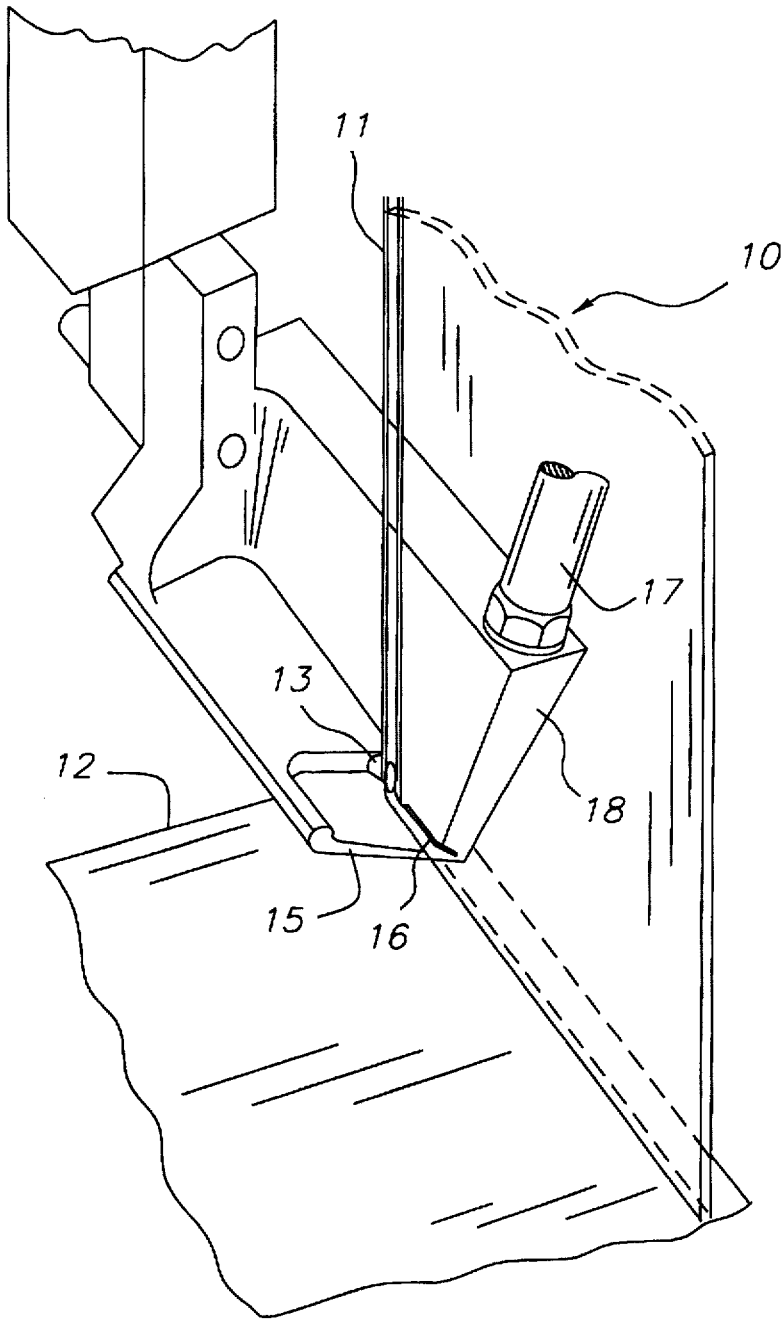
FIG. 1 shows the edge removal means of the prior art. The vacuum slot runs parallel to the curtain at a distance of about 1 mm. The face of the slot is inclined to the vertical and is not in contact with the edge guide. The slot extends to the edge of the blade.

FIG. 1 shows a curtain 10 and the lower portion of edge guide 11 according to the prior art of U.S. Pat. No. 5,395,660. The edge guide maintains the width of the curtain from the hopper lip 28, (see FIG. 2) on coating hopper means 27, to the support 12 moved by conveying means 31 to be coated. For the wire edge guide shown in FIG. 1, a pin 13 maintains tension and position. A band of lubricating liquid 26 adjoins the edge guide and is preferably removed prior to coating the support. The lubricating liquid and an adjoining band of the coating composition are intercepted by a solid blade 15 spaced closely to the support and removed by a slot 16 adjacent the blade connected to a vacuum inlet 17. The entrance to the vacuum slot 16 runs parallel to the curtain at a distance of about 1 mm. The unit comprising the blade, slot, and vacuum inlet may be removable from the edge guide and is called the vacuum block 18.

We have found a way to reduce fouling of the external and internal surfaces of the vacuum block and extend run times, which is to make geometric changes altering the air flow pattern while maintaining the same vacuum setting and slot height. This result is surprising because the velocity and temperature of the entering air are unaffected.

Figure 2:
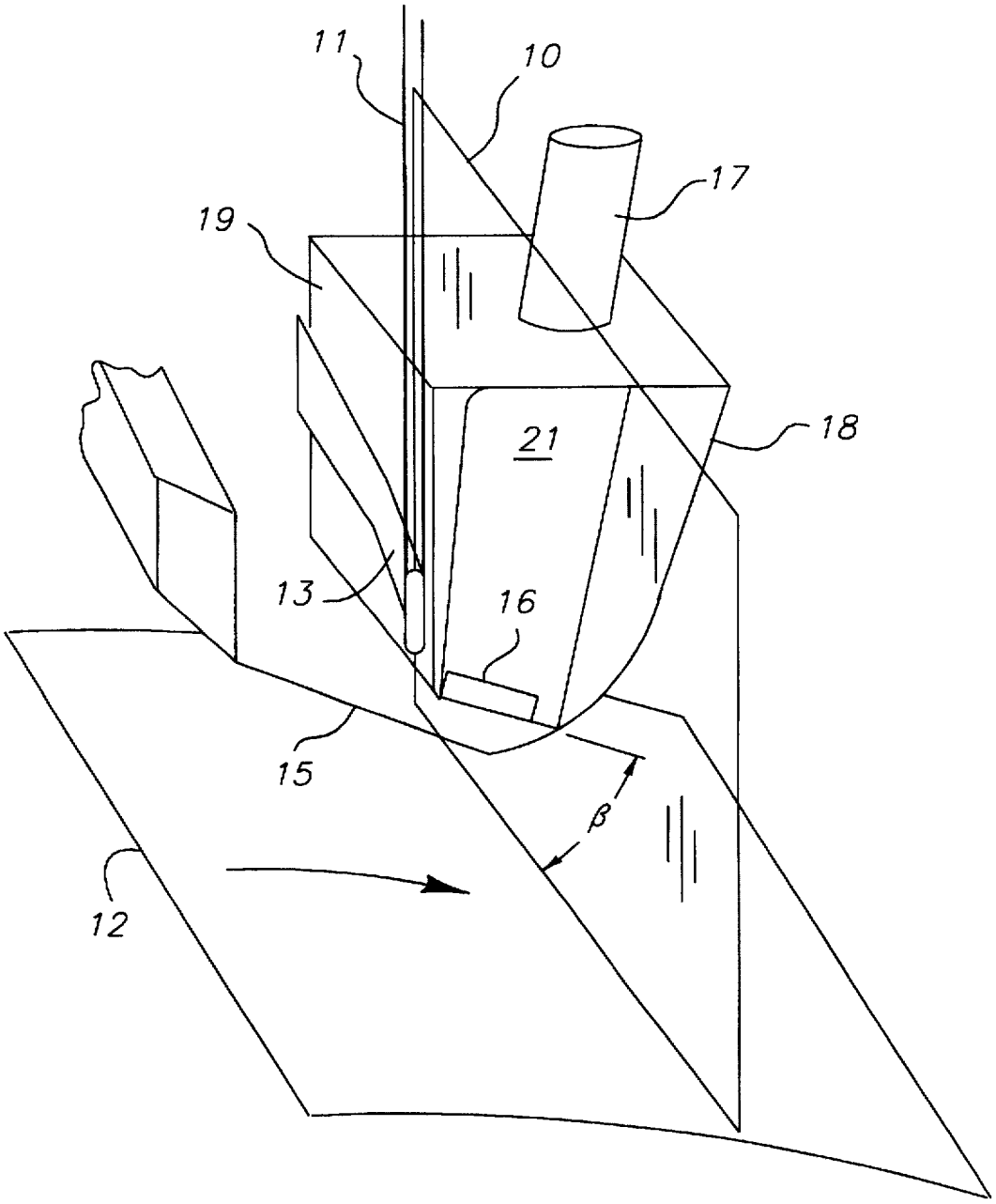
FIG. 2 shows the improved geometry of the edge removal means according to the present invention without flushing liquid distributing means. This geometry provides benefit, particularly in keeping the face of the slot clean.

The process shown in FIG. 2 involves three steps. The vacuum slot 16 is set at a substantial angle β to the plane of the curtain 10, in the range of 10–50 degrees, so that the distance between the slot and curtain increases as the edge of the blade 15 is approached. The second step is to bring the edge guide 11 into contact with a vertical face of the vacuum block 19 so that the curtain and edge guide block air access to the slot 16 from the outboard direction. The third step is to terminate the vacuum slot 16 before reaching the edge of the blade. These steps have the visible effect of maintaining the face of the block surrounding the slot free of buildup. Such buildup can cover over the slot entrance or feed into the slot and partially or completely block the liquids intercepted by the blade.

How the changed geometry eliminates buildup on the external surfaces of the vacuum slot, thereby eliminating the accumulation that ultimately covers or occludes the vacuum slot, is not known with certainty. It appears that the altered air flow more directly evacuates the edge guide flushing liquid, with its skin of coating composition, through the vacuum slot. The edge guide flushing liquid 30 from flushing means 29 appears not to contact the blade surface outside the vacuum slot at all but is turned directly into the slot by the air stream. Similarly, the edge guide flushing liquid contacts at most a small length on the external face of the vacuum slot. The length that is seen is adjacent the edge guide; flow of the flushing liquid is vertically downward into the slot, and the skin of coating composition is carried unhindered into the slot.

Figure 3:
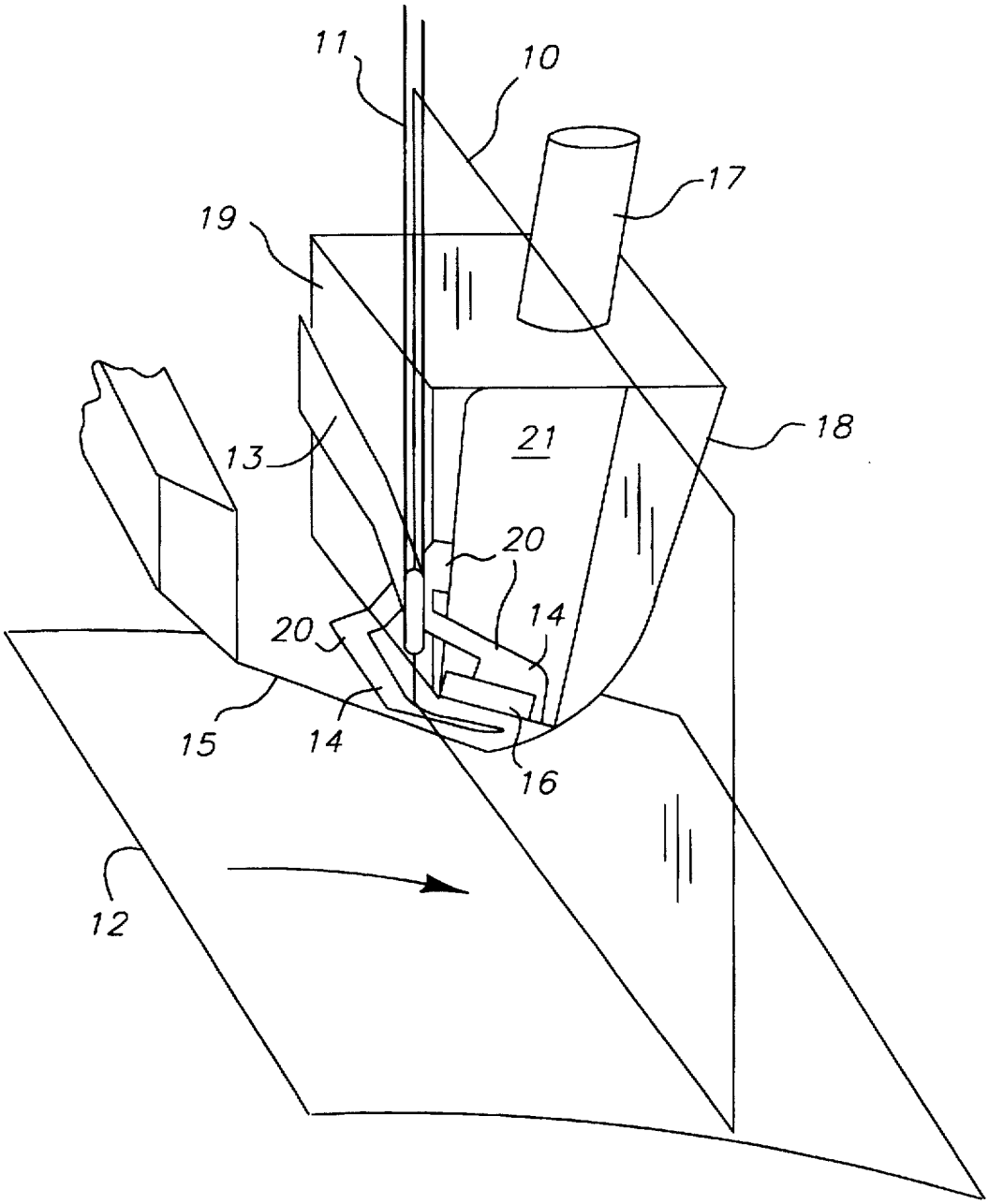
FIG. 3 shows the addition of flushing distributing means consisting of channels beginning in wetting contact with the edge guide flushing liquid and ending at or near the perimeter of the slot entrance.
Figure 4:
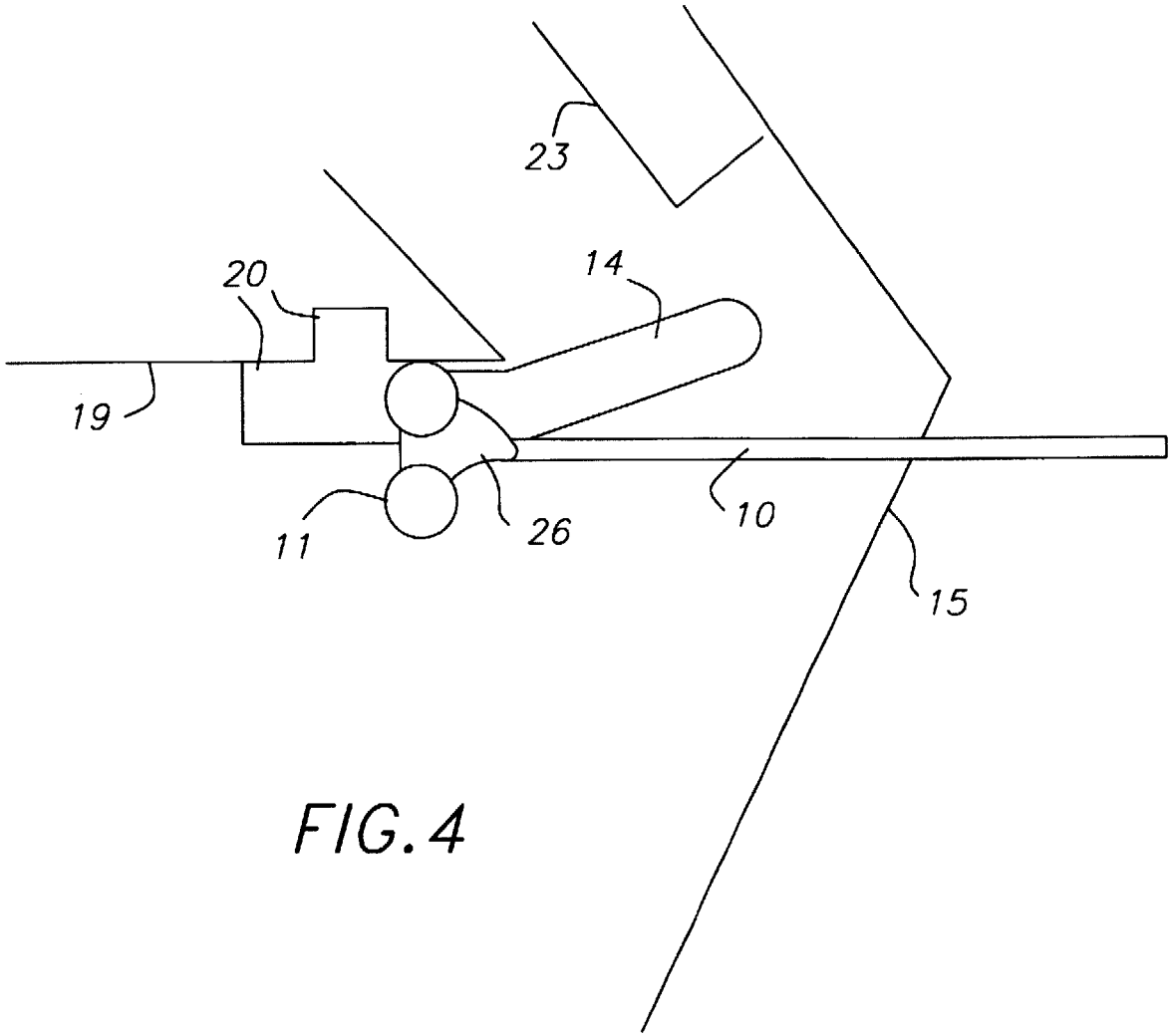
FIG. 4 is a view of the apparatus of FIG. 3 from above, cross sectioned at the plane of the blade surface. To show the proximity of the edge guide to the vertical face of the vacuum block that blocks air entry and facilitates wetting contact, the position of the edge guide wires and curtain are also indicated although these do not extend to the blade surface.
Figure 5:
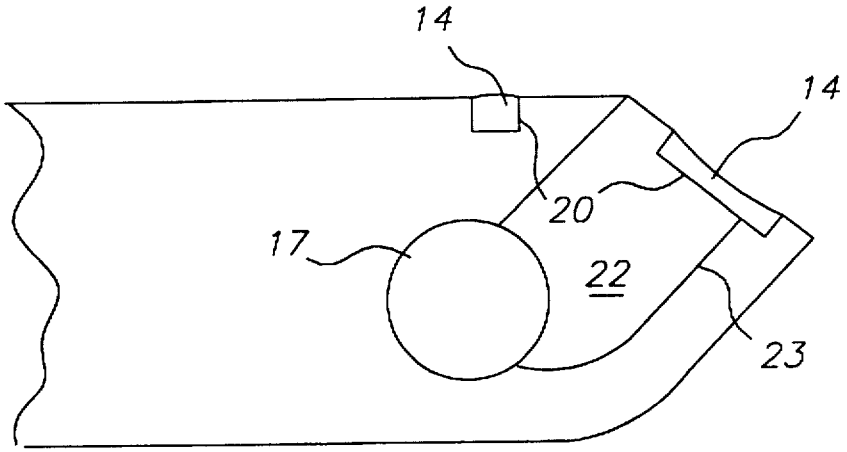
FIG. 5 is a view of the vacuum block in the plane of the blade viewed perpendicularly. The ends of the channels in the face of the block supplying the blade surface and the top and outboard surfaces of the slot with flushing liquid are shown.

A particularly preferred embodiment has the invention combined with U.S. Ser. No. 08/795,097 filed 05 Feb. 1997 entitled, "EDGE REMOVAL APPARATUS INCLUDING AIR-FLOW BLOCKING MEANS FOR CURTAIN COATING" by William D. Devine et al. This involves redistributing the edge guide flushing liquid to encompass the intercepted portion of the coating liquids and requires that the edge guide flushing liquid make wetting contact with both the blade and the face of the slot. Wetting is accomplished by contacting a vertical face 19 of the vacuum block 18 with the flushed edge guide 11 as shown in FIGS. 3, 4 and 5. From the region of wetting contact, channels 20 are cut in the slot face 21 and blade 15 surfaces to carry flushing liquid to encompass coating liquids intercepted by the blade. At least one channel leads to the blade and mates with at least one channel in the blade that extends across all or a portion of the slot entrance as shown in FIG. 4. In this way, flushing liquid is brought between the blade surface and the opposing surface of the intercepted coating liquids. At least one other channel is cut in the slot face 21 leading to the upper edge of the slot entrance as shown in FIG. 3. In this way a portion of the edge guide flushing liquid is brought to some portion or all of the top internal surface of the slot 22 and the side surface of the lot in proximity to the blade edge 23. In this way, flushing liquid is brought between these surfaces of the slot and the opposing surface of the intercepted coating liquids.

Figure 7:
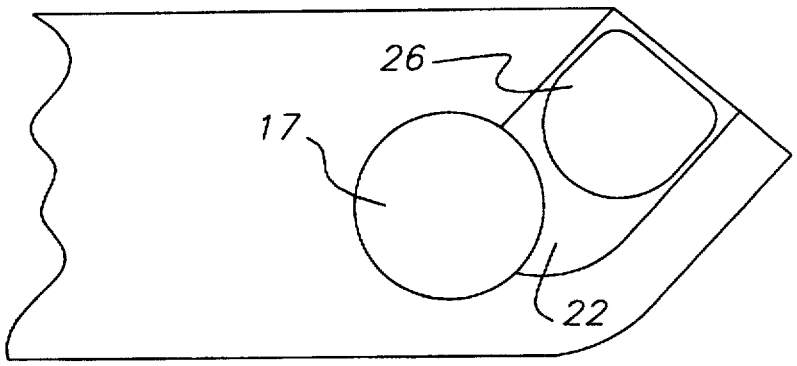
FIG. 7 is a view of the vacuum block with externally supplied flushing liquid from below in the plane of the top surface of the slot. The outlet for the internal conduit for the flushing liquid is shown.
Figure 6:
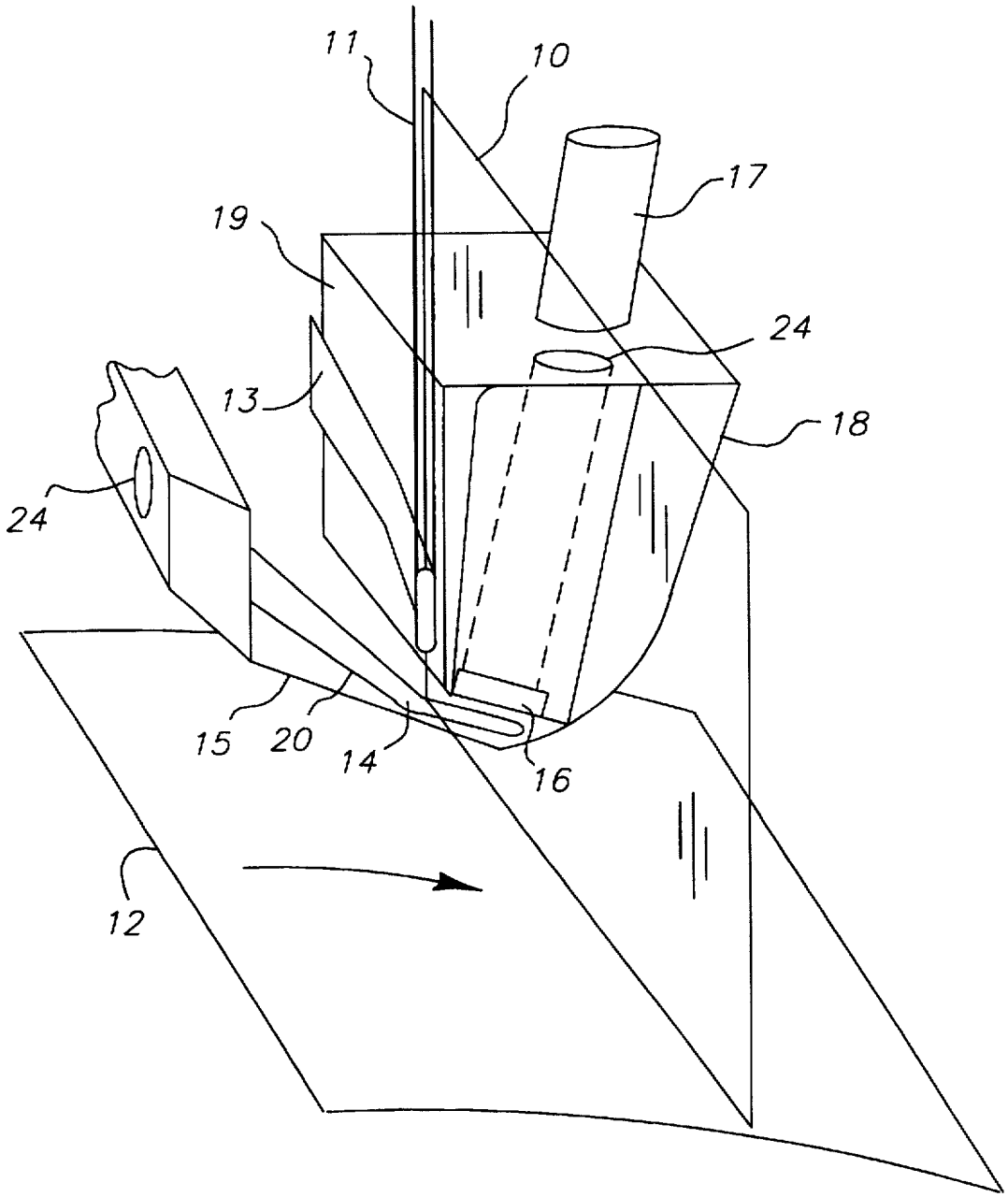
FIG. 6 is a view of the vacuum block with externally supplied flushing liquid. The inlets for the flushing liquid are shown. A channel in the blade delivers the flushing liquid to the threshold of the vacuum slot. A conduit through the block brings flushing liquid to the top surface of the slot.

Instead of redistributing the edge guide flushing liquid, additional flushing liquid can be supplied as shown in FIG. 6. Flushing liquid is supplied to an inlet 24 in the vacuum block 18 to at least one channel 14, 20 cut in the blade. The channels supply flushing liquid to the blade surface at the threshold of slot 16. Preferably, the channel extends at least to the line of apparent intersection of the curtain 10 and blade 15. Similarly, at least one externally supplied channel can be constructed to bring flushing liquid to the top side 22 and inboard side 23 of slot 16. A more direct alternative is to create a conduit 25 in the vacuum block with outlet 26 in the top surface of the slot as of slot 16. The outlet must also be close to the slot entrance, within about 0.050 inch, or fouling can occur between the slot entrance and the outlet. To this end the shape of the outlet can be squared off as shown in FIG. 7. The principal advantage of the conduit is that complete capture of the flushing liquid is certain.

Gravity and capillary wicking cause flushing liquid to fill the channels. Preferably the channels have a downward inclination to make use of gravity. To enhance capillary wicking, the channels are preferably narrow and of rectangular cross section. Capillary wicking in such channels can be so strong that flushing liquid can be carried even vertically upward, although a downward inclination is preferable.

The preferred embodiment is the improved geometry shown in FIG. 2 which can also be combined with flush water distributing means that is supplied either from the edge guide flushing liquid or from additional supplies. Examples of the preferred embodiment are shown in FIGS. 3 to 7.

EXAMPLE 1

The advantages of the current invention over that of the prior art in avoiding or reducing the amount of solidified coating material that is deposited on edge liquid removal device surfaces is illustrated by the following example. A liquid curtain was formed by means of a slide hopper. The liquid curtain consisted of an aqueous solution of gelatin, dye, surfactant, and hardening agent. The solution was 15 percent gelatin by weight. Rheological analysis conducted at the temperature of the falling curtain showed that the reaction of the hardening agent with the gelatin was such that the gelatin would be crosslinked to such a degree so as to be considered completely solidified after a period of only 130 minutes. This represents a solidification rate that is substantially accelerated over normal operating conditions thereby allowing for evaluation of the propensity for deposition of solidified coating material on edge liquid removal devices in a relatively short amount of time. The viscosity of the liquid curtain was 70 centipoise, and the flow rate was 1.3 cubic centimeters per second per centimeter of curtain width.

The curtain was anchored on each vertical edge by a pair of wires. Edge guides of this type are described in U.S. Pat. No. 5,328,726. The edge guide flushing liquid was water flowing at 30 cubic centimeters per minute. Two different edge liquid removal devices were used. One was a blade and slot arrangement in accordance with the prior art where the slot was parallel to the plane of the curtain as shown in FIG. 1. The slot was uniformly spaced from the curtain at a distance of approximately 1 millimeter with the slot terminating at the edge of the blade. The other edge liquid removal device was in accordance with the current invention as shown in FIG. 2 in which the slot was set an angle of 30 degrees from plane of the curtain, and the slot terminated approximately 0.040 inches from the edge of the blade. Both edge liquid removal devices intercepted a portion of the free-falling curtain of approximately 0.125 inches, including the edge guide flushing water.

For the prior art edge liquid removal apparatus, it was observed that solidified coating composition was almost immediately deposited on the surface above the slot. The amount of solidified coating composition above the slot increased rapidly over time. After a period of one hour, there was a profuse amount of solidified coating composition deposited above the slot. Further, it was observed that this deposit had become of such a gross nature so as to sag down into the slot itself, creating a substantial occlusion of the slot. For the edge liquid removal apparatus of the current invention, there was essentially no solidified coating composition deposited above the slot. There was only a scant ring of solidified material present on the inside perimeter of the slot that was of an amount that was very substantially less than the amount of solidified material that had deposited on the edge liquid removal apparatus of the prior art.

EXAMPLE 2

An experiment was performed to compare the performance of the prior art (U.S. Pat. No. 5,393,660) edge liquid removal apparatus (vacuum block) to that of the preferred embodiment of the current invention. A liquid curtain was formed by means of a slide hopper. The liquid curtain consisted of an aqueous solution of gelatin, dye, surfactant, and hardening agent. The solution was 15 percent gelatin by weight. Viscometric measurements conducted at the temperature of the falling curtain showed that the reaction of the hardening agent with the gelatin was such that the gelatin would be crosslinked to such a degree so as to be considered solidified after a period of approximately 130 minutes. The viscosity of the liquid curtain was 74 centipoise, and the flow rate was 1.3 cc/s per cm of curtain width.

The curtain was anchored on each vertical edge by a pair of wires. Edge guides of this type are described in U.S. Pat. No. 5,328,726. The edge guide flushing liquid was water flowing at 30 cc/min.

On one vertical edge of the curtain, an edge liquid removal apparatus in accordance with the prior art was used. On the other vertical edge, an edge liquid removal apparatus in accordance with the current invention as shown in FIG. 3 and previously described was used. Flush liquid distributing means consisted of channels cut transversely into the blade and above the slot that were in wetting contact with the edge guide flushing water. The channel above the slot had a depth of 0.020 inch and a width of 0.032 inch. The channel in the blade had a depth of 0.015 inch and a width of 0.050 inch at the threshold of the slot entrance.

Both edge liquid removal devices intercepted a portion of the free falling curtain of approximately 0.125 inch, including the edge guide flushing water. Both edge liquid removal devices were connected to a common vacuum source by means of duplicate conduits and fittings. The vacuum levels for both devices were initially set to 130 inches of water below atmospheric pressure by means of separate air bleed valves.

At the beginning of the experiment, both edge liquid removal devices were rinsed with water. After two hours from the start of the experiment, it was observed that the efficiency of the prior art edge liquid removal apparatus in removing the falling curtain was reduced. Less of the coating composition intercepted by the blade was being removed. There was no degradation in the performance of the edge liquid removal device of the invention. Such a reduction in efficiency could result in a shutdown of a coating operation, depending upon drying capabilities.

Continued observation showed that the efficiency of the prior art edge liquid removal apparatus continued to deteriorate over time. It was observed that the vacuum reading for the prior art edge liquid removal apparatus was rising over time. These observations are indicative of a growing deposit of solidified coating composition in or around the vacuum slot. Through the course of the experiment, the vacuum reading on the edge liquid removal apparatus of the current invention remained steady at 130 inches of water vacuum. A steady reading indicates the absence of any significant deposit of solidified coating composition in or around the vacuum slot.

After a period of approximately 5 hours from the start of the experiment, the prior art edge liquid removal apparatus was observed to be failing to remove all of the edge guide flushing water. This indicates a condition of nearly total plugging of the vacuum slot.

While the prior art edge removal apparatus was in a failed condition, the edge liquid removal apparatus of the current invention showed no degradation in the efficiency of removal of the intercepted coating composition and flushing liquid.

After 6 hours from the beginning of the experiment, the test was terminated, and both edge liquid removal devices were inspected. On the vacuum block in accordance with the prior art, substantial deposits of solidified coating composition were present above and over as well as inside the suction slot; a portion of the suction slot was found to be completely occluded. Substantial deposits of solidified gelatin were also present on much of the blade surface. Inspection of the edge liquid removal apparatus of the current invention following the conclusion of the experiment showed virtually no solidified coating composition.

The performance of the edge liquid removal apparatus of the current invention in this experiment is very remarkable considering the rapid rate at which the gelatin solidifies due to the chemical reaction with the hardening agent as well as rapid solidification due to chill setting by virtue of the high gelatin concentration. The greatly improved performance of the current invention over the prior art is especially remarkable considering that both devices were intercepting the same amounts of coating and flushing liquids.

While the invention has been described with particular reference to a preferred embodiment, it will be understood by those skilled in the art that various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. A method of curtain coating a support with at least one layer of a liquid coating composition comprising:

a) moving the support along a path through a coating zone;

b) forming one or more layers of coating liquids to form a composite layer;

c) forming a free falling curtain from said composite layer within said coating zone which extends transversely of said path and impinges on said moving support;

d) laterally guiding said falling curtain by edge guides arranged so that the curtain coats less than the width of said support;

e) maintaining said falling curtain in wetting contact with said edge guides by distributing flushing liquid from said edge guides contiguous with said falling curtain;

f) removing liquids from an edge of said falling curtain by providing a blade extending from an edge guide into the falling curtain to intercept a part of the free falling curtain and positioning the blade above the impingement of the falling curtain on the support wherein the blade is angled into the free falling curtain so that the blade is closest to the support where the part of the free falling curtain is intercepted and farthest from the support at an edge guide;

g) removing by suction means the liquids of the free falling curtain intercepted by the blade; and h) blocking air to said suction means from a direction of the exit of said means and directing said suction means to draw air from a direction of an entrance of said means towards the curtain.

2. The method of claim 1 additionally comprising:

i) distributing flushing liquid of step h) to encompass the intercepted liquids of the free falling curtain.

3. The method of claim 1 wherein one end of a slot begins at a vertical surface in contact with an edge guide and extends toward a blade edge at an angle $\beta$ of 10–50 degrees from the plane of the curtain and ends at a distance of 0.010–0.060 inches from the edge of the blade.

4. The method of claim 3 wherein the angle $\beta$ is 30 degrees, and the slot terminates 0.040 inches from the blade edge.

5. An apparatus for curtain coating a support by depositing one or more coating liquids onto a moving support comprising:

a) conveying means including a coating roll for moving said support having a width along a path through a coating zone;

b) hopper means for forming one or more flowing layers of coated liquids to form a free falling curtain which extends transversely of said path and impinges on said moving support;

c) edge guide means spaced a distance apart to produce a coating less than the width of said support for laterally guiding said falling curtain;

d) flushing means for issuing liquid from said edge guide to maintain wetting contact with said falling curtain;

e) liquid removal means for extracting liquid from an edge region of said falling curtain, the liquid removal means comprising:

i) a blade having an upper surface extending into the free falling curtain to intercept a part of the free falling curtain, said blade not contacting said support;

ii) a slot aligned and adjacent the upper surface of said blade, a face surface of the slot starting as a vertical surface in contact with an edge guide, and said slot making an angle β with the plane of the curtain such that the distance of the slot from the curtain increases as the edge of the blade is approached, and terminating the slot before the edge of the blade; and iii) suction means for providing a vacuum to said slot wherein the part of the free falling curtain intercepted by said blade is suctioned through said slot such that drag on the free falling curtain is minimized.

6. The apparatus of claim 5 wherein one end of the slot begins at a vertical surface in contact with the edge guide and extends toward the blade edge at an angle β of 10–50 degrees from the plane of the curtain and ends at a distance of 0.010–0.060 inches from the edge of the blade.

* * * * *